US007625520B2

(12) United States Patent
Peng et al.

(10) Patent No.: US 7,625,520 B2
(45) Date of Patent: Dec. 1, 2009

(54) MANUFACTURING METHOD FOR HIGH YIELD RATE OF METAL MATRIX COMPOSITE SHEET PRODUCTION

(75) Inventors: Jack Y. Peng, Westlake Village, CA (US); Mark R. van den Bergh, Los Angeles, CA (US); William C. Harrigan, Northridge, CA (US)

(73) Assignee: DWA Technologies, Inc., Chatsworth, CA (US)

( * ) Notice: Subject to any disclaimer, the term of this patent is extended or adjusted under 35 U.S.C. 154(b) by 0 days.

(21) Appl. No.: 10/718,101

(22) Filed: Nov. 18, 2003

(65) Prior Publication Data

US 2005/0106056 A1 May 19, 2005

(51) Int. Cl.
*B22F 7/00* (2006.01)
*B22F 7/04* (2006.01)

(52) U.S. Cl. ..... 419/8; 419/10; 419/28

(58) Field of Classification Search ..... 419/10, 419/28, 8

See application file for complete search history.

(56) References Cited

U.S. PATENT DOCUMENTS 3,639,179 A * 2/1972 Reichman et al. ..... 75/246
3,834,004 A * 9/1974 Ayers ..... 419/28
3,840,367 A * 10/1974 Rudy ..... 51/293
4,002,503 A * 1/1977 Bourne et al. ..... 148/514
4,027,377 A * 6/1977 Roszler ..... 419/50
4,045,847 A * 9/1977 Walford ..... 28/101
4,104,061 A 8/1978 Roberts
4,121,928 A * 10/1978 Mori ..... 419/3
4,126,451 A * 11/1978 Nayar ..... 419/8
4,138,250 A * 2/1979 Kajinaga et al. ..... 419/28
4,478,787 A * 10/1984 Nadkarni et al. ..... 419/8
4,557,893 A 12/1985 Jatkar et al.
4,575,450 A * 3/1986 Meunier ..... 419/41
4,597,792 A * 7/1986 Webster ..... 75/249
4,623,388 A 11/1986 Jatkar et al.
4,634,571 A 1/1987 Langhans et al.
4,705,577 A 11/1987 Ondracek et al.
4,722,751 A * 2/1988 Akechi et al. ..... 75/232

(Continued)

FOREIGN PATENT DOCUMENTS

JP 61194101 A * 8/1986

OTHER PUBLICATIONS

Cubberly et al, ASM Handbook, 1994, ASM International, vol. 7, pp. 381-383 and 495-496.*

*Primary Examiner*—Harry D. Wilkins, III
*Assistant Examiner*—Nicholas A. Smith
(74) *Attorney, Agent, or Firm*—Thomas I. Rozsa

(57) ABSTRACT

A manufacturing method for producing metal matrix composite (MMC) sheets without intermediate process losses associated with extrusion and rolling edge cracks. The method results in theoretical sheet yield rates from the initial MMC billet of up to 100%, compared to 30 to 60% yield rates for prior-art manufacturing processes. The methods in this invention comprise the following processes: (a) preparing a MMC powder mixture; (b) preparing a frame and a billet consolidation tool; (c) loading and compacting the MMC mixture to form a framed MMC compact; (d) consolidation of the framed MMC compact to form a framed MMC billet; (e) preparing the framed billet to be a framed roll-preform; and (e) rolling the framed roll-preform to MMC sheet.

21 Claims, 2 Drawing Sheets

U.S. PATENT DOCUMENTS 4,722,754 A * 2/1988 Ghosh et al. ..... 75/236
4,923,671 A * 5/1990 Aslund ..... 419/8
4,946,500 A 8/1990 Zedalis et al.
4,992,238 A * 2/1991 Couper et al. ..... 419/41
5,006,289 A * 4/1991 Yamamoto et al. ..... 264/603
5,039,476 A * 8/1991 Adachi et al. ..... 419/13
5,061,323 A * 10/1991 DeLuccia ..... 419/32
5,100,736 A * 3/1992 London et al. ..... 428/549
5,149,496 A * 9/1992 Das et al. ..... 419/17
5,382,405 A * 1/1995 Lowrance et al. ..... 505/125
5,486,223 A * 1/1996 Carden ..... 75/244
5,561,829 A * 10/1996 Sawtell et al. ..... 419/13
5,574,957 A * 11/1996 Barnard et al. ..... 419/67
5,965,829 A 10/1999 Haynes et al.
5,980,602 A * 11/1999 Carden ..... 75/236
6,554,714 B2 * 4/2003 Kurecka et al. ..... 464/183
6,602,314 B1 * 8/2003 Sakaguchi et al. ..... 75/249
6,852,273 B2 * 2/2005 Ivanov et al. ..... 419/5

* cited by examiner

EXHIBIT A

MANUFACTURING METHOD FOR HIGH YIELD RATE OF METAL MATRIX COMPOSITE SHEET PRODUCTION

BACKGROUND OF THE INVENTION

1. Field of the Invention

The present invention generally relates to the methods of batch processing powder-metallurgy (P/M) aluminum alloy and metal matrix composite (MMC) sheet and plate products. More particularly, the present invention relates to the method of manufacturing such product at yield rates higher than conventional batch processes.

2. Description of the Prior Art

Powder-metallurgy MMC's are advanced composite materials that are made from metal powders and reinforcement materials by powder-metallurgy manufacturing methods. P/M MMC can be produced in many forms, such as extruded tubes and rolled sheets.

P/M MMC sheets have many applications in aerospace such as skins and control surfaces, and in the nuclear industry as neutron absorbing material. Each of these applications uses MMC for its special properties which are controlled by different MMC compositions. However, all P/M MMC sheet products produced by prior-art manufacturing methods suffer from low production yield rates from the initial cylindrical shaped billets.

Typical sheet yield-rates are approximately 30 to 60% from an initial MMC billet. The higher the percentage of reinforcement in the MMC, the lower the recovery rate for MMC sheet production. The low sheet yield rate reduces productivity and increases cost, and also generates large quantities of scrap. The scrap cannot be recycled as composite and must be recycled as dirty metal, which severely reduces the recovery price. The matrix metal is usually recovered. However, the expensive reinforcing material such as boron carbide is removed with the flux and discarded. As a result, low yield rate and high cost-of-production in current manufacturing processes have limited the applications of MMC sheets, even though they have properties superior to conventional metallic sheets.

There have been many efforts to make metal matrix composites, as demonstrated in, for example: U.S. Pat. No. 4,104,061 issued to Roberts; U.S. Pat. Nos. 4,557,893 and 4,623,388 issued to Jatkar et al.; U.S. Pat. No. 4,946,500 issued to Zendalis et al.; U.S. Pat. No. 4,722,751 issued to Akechi; U.S. Pat. No. 5,561,829 issued to Sawtell et al.; U.S. Pat. No. 5,965,829 issued to Haynes et al.; and U.S. patent application Ser. No. 60/387,781 filed by Harrigan et al. However, none of these works addressed the manufacturing problem of low yield rate for P/M MMC sheet production.

A typical prior-art manufacturing process for P/M MMC sheet production is illustrated in FIG. 1, often called the billet-extrusion-rolling (BER) processing. An initial cylindrical MMC billet is extruded into a rectangle-shaped workpiece followed by hot rolling to the desired thickness. The extrusion process is used not only to convert the billet into an easily rolled product form. It also imparts thermo-mechanical work to the MMC which improves its mechanical properties leading to improved rolling behavior.

The extruded rectangle workpiece possesses a nose defect at the lead end and pipe defect at the butt end. The nose defect manifests itself as a radiused leading edge that has little or no hot work and must be removed during the preparation of the roll preform. The pipe defect is a linear discontinuity that occurs because the center of the MMC billet flows faster than the outside due to friction between extrusion press container, the die surface and the MMC billet.

If a MMC workpiece is rolled without the nose defect removed, significant edge cracking may develop during the rolling process which reduces the recovery rate. If a MMC workpiece is rolled without the pipe defect removed, the final sheet product will contain a large delamination near the centerline of the thickness. Therefore, the nose and pipe defects must be removed from the extrusion in order to produce good quality sheet. Material losses associated with the extrusion process are about 15 to 18%.

Edge cracking of the MMC roll-preform occurs during the rolling process. Edge cracks are caused by the limited ductility of the MMC, high shear stresses in the work piece, and the low working temperature at the sheet edges. An edge crack can be as long as 15 cm (~6") from the rolled sheet edges. Edge cracking during the rolling process can represent approximately 28% of the weight of the MMC roll-preform, and they must to be removed from the final sheet product before delivery to the customer.

A "picture frame" rolling method is used to roll materials that have limited ductility. The method uses a metallic picture frame surrounding the material to be rolled. The picture frame and roll preform are rolled together as an assembly. The frame minimizes or prevents rolling edge cracks.

For example, U.S. Pat. No. 4,705,577 issued to Ondracek et al. and U.S. Pat. No. 4,634,571 issued to Langhans et al. described the picture frame method to roll nuclear fuel composites. The frame is retained as part of the final product.

A picture frame rolling method has been used for rolling aluminum MMC (Al-MMC) sheet. A machined aluminum frame was heated and an Al-MMC rectangular roll-perform was placed inside the frame. As the frame cooled, it shrank to a tight fit around the rectangle Al-MMC. The framed Al-MMC was heated and rolled with multiple passes on a rolling mill to final thickness. The aluminum frame did not retain a tight fit with the rectangular Al-MMC roll preform during all rolling passes because the frame was not metallurgically bonded with the Al-MMC. Therefore, edge cracks, although reduced in length, occurred during the rolling process.

There is also a "box-frame" method used to produce a MMC sheet. Blended boron carbide and aluminum powder is loaded to a welded aluminum box. The mixture is compacted at room temperature and an aluminum lid is welded in place to seal the box. The box-frame with the blended powder mixture is heated and then rolled to produce a MMC sheet with monolithic aluminum cladding sandwiched on either side of a MMC core that is not fully densified. Such sandwich sheet has poor mechanical and thermal properties and suffers from delamination and blistering problems in corrosive environments. As a result, sandwich sheets have limited applications.

Therefore, there is a real need to improve the manufacturing technology for MMC sheet, with the specific objective being improved yield rates.

SUMMARY OF THE INVENTION

The present invention is a novel and unique method of manufacturing powder-metallurgy (P/M) metal matrix composite (MMC) sheets.

According the method of the present invention, hot-pressed P/M MMC billets are directly rolled to P/M MMC sheets, bypassing the extrusion process and therefore avoid the approximately 18% yield loss associated with the extrusion process.

The present invention method produces a square or rectangular P/M MMC billet with a metallurgically bonded metal frame incorporated during the billet manufacturing process. The framed MMC billet can be rolled to sheet without edge cracks.

The manufacturing process of the present invention includes the following major sequential steps:

(a) Blending of MMC raw materials;

(b) Preparation of the metal frame and billet consolidation tool;

(c) Loading and compaction of the blended powders;

(d) Consolidation of the framed-compact to form the framed-billet; and (e) Rolling of the framed P/M MMC billet.

The main advantage of the present invention is that the sheet yield rate from MMC billet, according to the present invention method, is approximately 80 to 100% compared to 30 to 60% in prior-art manufacturing methods.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
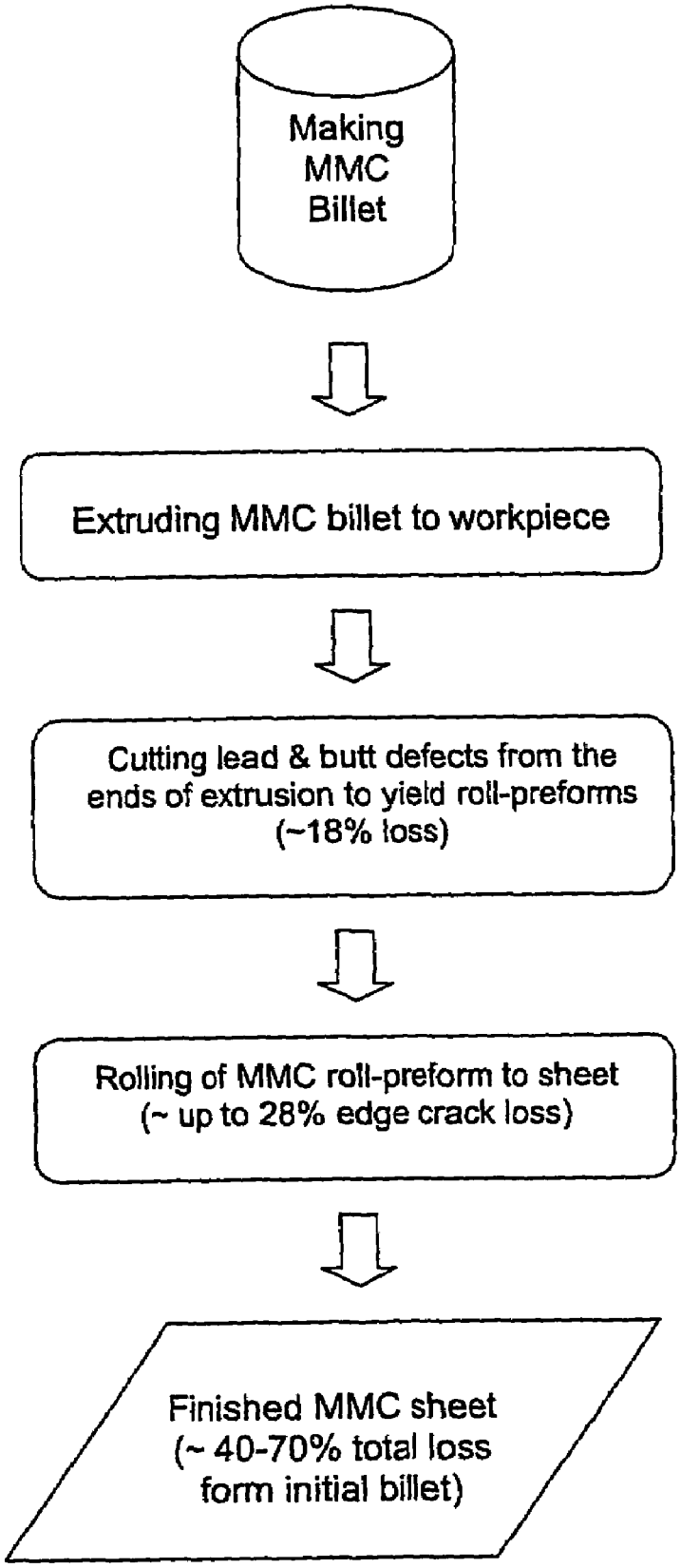
FIG. 1 PRIOR ART
FIG. 1 is an illustrative diagram showing a prior art manufacturing process.
Figure 2:
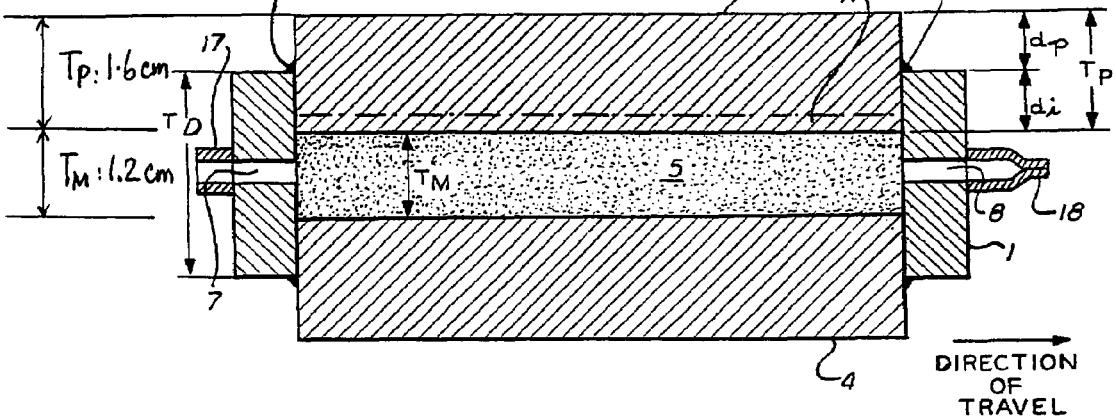
FIG. 2 is an illustrative diagram showing the present invention manufacturing process.

The major sequential steps of the manufacturing method of this invention are illustrated in FIG. 2, including:

Step 1: Blending of MMC Raw Materials

Matrix metal powder and reinforcement material are blended uniformly at room temperature to produce the MMC mixture.

The matrix metal powder is selected from the group consisting of aluminum, magnesium, copper, iron, zinc, nickel, cobalt, titanium, and alloys thereof. The matrix metal is in particulate form. The average particle size is less than approximately 100 microns.

The reinforcement material is selected from the group consisting of silicon carbide, silicon nitride, titanium nitride, titanium carbide, titanium silicide, molybdenum silicide, nickel aluminate, boron carbide, aluminum nitride, aluminum oxide, magnesium oxide, gadolinium oxide, ceramic materials and mixtures thereof. The reinforcement is also selected from the group of aluminum, boron, cobalt, copper, iron, magnesium, nickel, silicon, titanium, zinc, alloys and mixtures thereof.

The reinforcement material can have the physical shape of particulate, whiskers, fibers, and mixtures thereof. The average particle size in particulate form is less than approximately 100 microns.

The matrix metal powder makes up between about 55 and 95 volume percent of the mixture. The reinforcement makes up between about 5 and 45 volume percent of the mixture.

Step 2: Preparing the Metal Frame and Billet Consolidation Tool

A metal cubic cylinder that has a removable bottom is prepared as a billet consolidation tool. A four-sided picture frame made of a metal similar to the matrix metal is placed in the billet tool. The outside walls of the picture frame are in close contact with the inside walls of the consolidation tool. A common lubricant such as that in forging processes can be applied on the inside walls of the consolidation tool for easier removal of the framed MMC billet after hot-pressing.

The picture frame can be configured such that the frame can act as the billet consolidation tool. Therefore, the separate billet consolidation tool is not necessary for supporting the picture frame. If the framed MMC billet is designed to be rolled in only one direction, only the two roll-preform sides that are parallel to the rolling direction are necessary to be framed because the other two sides will not have edge cracks during the one-direction rolling.

All sides of the MMC billet can be framed to form an encapsulating box-framed MMC billet for rolling as well. The box-framed MMC billet is rolled to produce sandwich structure sheet that has thin skins of the frame metal and a MMC core that is about 100% theoretical density. The skins and the MMC core are metallurgically bonded. This sandwich MMC sheet will not have blistering or delamination problems.

Of course the frame shape is not limited to square and rectangle. Round and other shapes are possible if they are needed.

Step 3: Loading and Compaction of the Blended Powders

The powder mixture is loaded to the frame and then is compacted at room temperature to form a framed-compact that is approximately 50% to 95% of the theoretical density.

Step 4: Consolidating the Framed-compact to Form a Framed-Billet

This step consolidates the framed MMC compact to form a framed-billet. The frame is also metallurgically bonded to the MMC billet during the operation.

There are various powder metallurgy methods to consolidate the framed-compact to form the framed-billet. The following are typical processes:

(1) Vacuum/Inert-gas/Air Hot-Press

Under vacuum, inert-gas or air, the framed-compact is heated to a degassing temperature range and then is held in the temperature range for more than about one-half hour for degassing. The degassing temperature range depends on the matrix metal and is from between about 230° C. (450° F.) and less than the lowest eutectic melt temperature of elemental powder in the matrix metal. The main function of degassing is to remove $H_2O$ from the MMC compact.

After the degassing period, the temperature is raised to the consolidation temperature, which is the highest eutectic melt temperature of elemental powder in the matrix metal. The consolidation temperature is lower than the melt temperature of the basic matrix metal. The consolidation temperatures are between about 230 and 615° C. (450 and 1145° F.) for aluminum MMC. While the consolidation temperature and vacuum, inert-gas or air are maintained, the degassed-compact is pressed to full density resulting in a framed-billet.

In the case of only one element metal in the matrix metal is used, the consolidation temperature is bellow the melt temperature of the element metal.

(2) Cold Isostatic Press/Sinter

In the Cold Isostatic Press/Sinter process, the MMC mixture is compacted at room temperature in Step C to about 85% to 95% of theoretical density. Pressing the powder mixture to high density at room temperature requires pressures between about 50,000 psi and 85,000 psi. Typically, a cold isostatic press (CIP) is employed.

The framed-compact is then sintered in vacuum, in inert-gas or in air. The framed-compact is heated to the degassing temperature range and then is held at this temperature range for more than about one-half hour to be degassed. After degassing, the degassed-framed-compact is heated to a sintering temperature that is the highest eutectic melt temperature of the elemental powder in the matrix metal so that sintering of the matrix takes place to form the framed-billet. This sintered MMC billet has a density that is still approximately that of the starting compact between 85% and 95% of the theoretical density, but is sealed by the sintering process. This sealing is needed to avoid internal oxidation of the billet during heating for rolling. The MMC sheet density is approximately 100% of theoretical density after the sintered billet is rolled.

CIP/Sinter is not suitable to produce P/M MMC that has only one elemental matrix metal because there is no transient eutectic melt required for sintering of matrix metal, (3) Cold Compacting/Hot Press The framed-compact produced in Step C is heated to the consolidation temperature in inert-gas or in air. While the consolidation temperature and inert-gas continue to be maintained, the framed-compact is hot pressed to approximately 98 to 100% of theoretical density to produce the framed-billet. There is no degassing period required in this process.

Step E: Rolling Framed-Roll-preform

The framed-billet is cleaned to produce a framed-roll-preform. The cleaning operation includes removing excessive frame metal from bottom and top surfaces and cleaning the roll surfaces by sandblasting, chemical mill or machining as necessary.

The framed-roll-preform is rolled to sheet according to a rolling schedule. If two-direction rolling is needed, the framed-roll-preform is rolled in one direction to produce the desired sheet width and then is rolled in the other direction to produce the desired length and final thickness.

The rolled frame metal is removed for recycling. The finished MMC sheet is then cut to final dimension.

Theoretically, the MMC sheet recovery rate could be up to 100% from the initial MMC powder mixture by the manufacturing method defined by this invention because of no in-process MMC loss. Practically, however, recovery rates of between about 80 and 95% are achievable.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

Of course the present invention is not intended to be restricted to any particular form or arrangement, or any specific embodiment, or any specific use, disclosed herein, since the same may be modified in various particulars or relations without departing from the spirit or scope of the invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted.

The invention claimed is:

1. A method of producing a framed-metal-matrix-composite-plate/sheet from a powder mixture, said method comprising: a. producing said powder mixture by uniformly mixing a matrix metal powder and at least one reinforcement material, wherein said reinforcement material is selected from the group consisting of silicon carbide, silicon nitride, titanium nitride, titanium carbide, titanium silicide, molybdenum silicide, nickel aluminate, boron carbide, aluminum nitride, aluminum oxide, magnesium oxide, gadolinium oxide, ceramic materials and mixtures thereof; b. loading said uniformly mixed powder mixture into a metal frame being a box framed on all sides to form a framed mixture, further comprising compacting said framed mixture to form a framed compact of a composite having 50% to 95% of the theoretical density and uniform composition; c. consolidating said framed compact to form a flamed-billet of a composite having a uniform composition that is between about 98% and about 100% of theoretical density, wherein said consolidation further comprises degassing of said framed compact to form a degassed-framed-compact; d. rolling said framed-billet to form said framed-metal-matrix-composite-plate/sheet without edge cracks, wherein said plate/sheet is comprised of thin skins of said frame metal, which encapsulate said metal-matrix-composite having uniform composition as a thick core; and; e. said method results in a high sheet yield rate for producing said framed-metal-matrix-composite-plate/sheet; comprising said thick core of the composite that has said uniform composition.

2. The method in accordance with claim 1, wherein said matrix metal powder is selected from the group consisting of aluminum, magnesium, copper, iron, zinc, nickel, cobalt, titanium, and alloys thereof.

3. The method in accordance with claim 1, wherein said matrix metal powder has an average particle size less than about 100 microns.

4. The method in accordance with claim 1, wherein said reinforcement material is selected from the group of aluminum, boron, cobalt, copper, iron, magnesium, nickel, silicon, titanium, zinc, alloys and mixtures thereof.

5. The method in accordance with claim 1, wherein said reinforcement material has the physical shape of particulate, whiskers fibers and mixtures having average diameter less than about 100 microns.

6. The method in accordance with claim 1, wherein said powder mixture comprises between about 55 vol. % and about 95 vol. % of said matrix metal and between about 5 vol. % and about 45 vol. % of said reinforcement material.

7. The method in accordance with claim 1, wherein said matrix metal powder comprises a pre-alloyed powder.

8. The method in accordance with claim 1, wherein said matrix metal powder comprises a mixture of at least one elemental powder.

9. The method in accordance with claim 1, wherein said metal frame comprises a perimeter frame.

10. The method in accordance with claim 1, wherein said metal frame comprises a two-sided frame.

11. The method in accordance with claim 1, wherein said metal frame comprises an encapsulating box frame.

12. The method in accordance with claim 1, wherein said step "c" further comprises the steps of:

a. pressing said framed-mixture at room temperature to form a framed-compact having a density of between about 50% and about 95% of theoretical density;

b. heating said framed-compact in a controlled environment at a degassing temperature range from about 230° C. (45020 F.) to less than the lowest eutectic melt temperature of elemental powder in said matrix metal powder;

c. degassing said framed-compact at said degassing temperature range for at least about one-half a hour to form a degassed-framed-compact;

d. heating said degassed-framed-compact to a consolidation temperature; and e. hot pressing said heated-degassed-framed-compact in said controlled environment to form a framed-billet having a density between about 98% and about 100% of theoretical density.

13. The method in accordance with claim 12, wherein said environment is a vacuum environment.

14. The method in accordance with claim 12, wherein said controlled environment is an inert-gas environment.

15. The method in accordance with claim 12, wherein said controlled environment is an air environment.

16. The method in accordance with claim 12, wherein said consolidation temperature is the highest eutectic melt temperature of elemental powder in said matrix metal powder having at least one elemental metal having lower melt temperature than melt temperature of a basic elemental metal powder in said matrix metal powder.

17. The method in accordance with claim 12, wherein said consolidation temperature for said matrix metal powder containing only said basic elemental metal powder is the temperature being below melt temperature of said basic elemental metal powder.

18. The method in accordance with claim 1, wherein said step "c" further comprises the steps of:

a. pressing said framed-mixture at room temperature to form a framed-compact having a density of between about 85% and about 95% of theoretical density;

b. heating said framed-compact in said controlled environment at said degassing temperature range from about 230° C. (450° F.) to less than the lowest eutectic melt temperature of element powder in said matrix metal powder;

c. degassing said framed-compact at said degassing temperature range for at least about one-half hour to form a degassed-framed-compact; and d. heating said degassed-framed-compact to a sintering temperature being the highest eutectic melt temperature of elemental powder in said matrix metal powder having at least one elemental metal having lower melt temperature than melt temperature of said basic element metal powder in said matrix metal powder to form said framed-billet having a density of between about 85% and about 95% of theoretical density.

19. The method in accordance with claim 18, wherein said controlled environment is a vacuum environment.

20. The method in accordance with claim 18, wherein said controlled environment is an inert-gas environment.

21. The method in accordance with claim 18, wherein said controlled environment is an air environment.

* * * * *